United States Patent [19]

Ogawa et al.

[11] Patent Number: 4,555,465

[45] Date of Patent: Nov. 26, 1985

[54] PHOTOCONDUCTIVE MEMBER OF AMORPHOUS SILICON

[75] Inventors: Kyosuke Ogawa, Tokyo; Shigeru Shirai, Yamato; Keishi Saitoh, Tokyo; Teruo Misumi, Kawasaki; Junichiro Kanbe, Yokohama, all of Japan

[73] Assignee: Canon Kabushiki Kaisha, Tokyo, Japan

[21] Appl. No.: 561,991

[22] Filed: Dec. 16, 1983

[30] Foreign Application Priority Data

Dec. 20, 1982 [JP] Japan ..... 57-222095

[51] Int. Cl.[4] ..... G03G 5/082

[52] U.S. Cl. ..... 430/95; 430/60; 430/66; 430/84

[58] Field of Search ..... 430/65, 66, 84, 95, 430/60

[56] References Cited

U.S. PATENT DOCUMENTS 4,414,319 11/1983 Shirai et al. ..... 430/84

4,423,133 12/1983 Kanbe et al. ..... 430/84

*Primary Examiner*—John L. Goodrow

*Attorney, Agent, or Firm*—Fitzpatrick, Cella, Harper & Scinto

[57] ABSTRACT

A photoconductive member comprising a support and a light receiving layer provided on said support, having photoconductivity containing silicon atoms as a matrix and at least hydrogen atoms as constituent atom, said light receiving layer having a layer region with depth profile such that the content of hydrogen atoms contained therein is decreased in the direction of layer thickness toward both ends of said layer.

28 Claims, 13 Drawing Figures

PHOTOCONDUCTIVE MEMBER OF AMORPHOUS SILICON

BACKGROUND OF THE INVENTION

1. Field of the Invention

This invention relates to a photoconductive member having sensitivity to electromagnetic waves such as light (herein used in a broad sense, including ultraviolet rays, visible light, infrared rays, X-rays, gamma-rays and the like).

2. Description of the Prior Art

Photoconductive materials, which constitute image forming members for electrophotography in solid state image pick-up devices or in the field of image formation, or photoconductive layers in manuscript reading devices, are required to have a high sensitivity, a high SN ratio (Photocurrent (Ip)/(Id)), spectral characteristics matching to those of electromagnetic waves to be irradiated, a rapid response to light, a desired dark resistance value as well as no harm to human bodies during usage. Further, in a solid state image pick-up device, it is also required that the residual image should easily be treated within a predetermined time. In particulary, in case of an image forming member for electrophotography to be assembled in an electrophotographic device to be used in an office as office apparatus, the aforesaid harmless characteristic is very important.

From the standpoint as mentioned above, amorphous silicon (hereinafter referred to as a-Si) has recently attracted attention as a photoconductive material. For example, German Laid-open Patent Publication Nos. 2746967 and No. 2855718 disclose applications of a-Si for use in image forming members for electrophotography, and German Laid-open Patent Publication No. 2933411 an application of a-Si for use in a reading device for a photoelectric conversion.

However, the prior known photoconductive members having photoconductive layers constituted of a-Si are further required to be improved in a balance of overall characteristics including electrical, optical and photoconductive characteristics such as dark resistance value, photosensitivity and response to light, etc., and environmental characteristics during use such as humidity resistance, and further stability with lapse of time.

For instance, when applied in an image forming member for electrophotography, residual potential is frequently observed to remain during use thereof if improvements to higher photosensitivity and higher dark resistance are scheduled to be effected at the same time. When such a photoconductive member is repeatedly used for a long time, there will be caused various inconveniences such as accumulation of fatigues by repeated uses or so-called ghost phenomenon wherein residual images are formed.

Further, according to a large number of experiments according to the present inventors, a-Si as the material constituting the photoconductive layer of an image forming member for electrophotography, while it has a number of advantages, as compared with inorganic photoconductive materials such as Se, CdS, ZnO or organic photoconductive materials such as PVCz or TNF of prior art, is also found to have problems to be solved. Namely, when charging treatment is applied for formation of electrostatic images on the photoconductive layer of an image forming member for electrophotography having a photoconductive member constituted of a mono-layer of a-Si which has been endowed with characteristics for use in a solar battery of prior art, dark decay is markedly rapid, whereby it is difficult to apply a conventional electrophotographic process. Moreover, this tendency is further pronounced under a humid atmosphere to such an extent in some cases that no charge is retained at all before development time.

Further, a-Si materials may contain as constituent atoms hydrogen atoms or halogen atoms such as fluorine atoms, chlorine atoms, etc. for improving their electrical, photoconductive characteristics, boron atoms, phosphorus atoms, etc. for controlling the electroconduction type as well as other atoms for improving other characteristics. Depending on the manner in which these constituent atoms are contained, there may sometimes be caused problems with respect to electrical or photoconductive characteristics of the layer formed.

Especially, in the vicinity of the surface or at the interface between the layers adjacent to each other, the problems of behaviors of the charges which will be changed variously depending on the kind of the atoms contained, their contents and profiles of distribution or stability of the structure become very important, and it is not seldom a key to have a photoconductive member exhibit its function as desired whether controlling of this part is successful or not.

Particularly, when a-Si photosensitive member is prepared by a method generally known in the art, difficulties are encountered in many cases such as repeating characteristics of images or durability thereof. While its mechanism has not been clarified so far, insufficiency with respect to repeating characteristic may be presumably the problem of the capacity of transporting charges in the vicinity of the surface or at the layer interface, and insufficiency with respect to durability caused by the structural change in the vicinity of the surface or at the layer interface. Accordingly, the layer design near the interface may be not seldom better designed on the basis of a thought slightly different from that in the bulk portion.

In view of the above points, the present invention contemplates the achievement obtained as a result of extensive studies made comprehensively from the standpoints of applicability and utility of a-Si as a photoconductive member for image forming members for electrophotography, solid state image pick-up devices, reading devices, etc. It has now been found that a photoconductive member having a layer constitution of photoconductive layer comprising a light receiving layer exhibiting photoconductivity, which is constituted of so-called hydrogenated amorphous silicon, or halogen-containing hydrogenated amorphous silicon which is an amorphous material containing at least one of hydrogen atom (H) and halogen atom (X) in a matrix of a-Si, especially silicon atoms (hereinafter referred to comprehensively as a-Si(H,X)), said photoconductive member being prepared by designing so as to have a specific structure as hereinafter described, is found to exhibit not only practically extremely excellent characteristics but also surpass the photoconductive members of the prior art in substantially all respects, especially having markedly excellent characteristics as a photoconductive member for electrophotography.

SUMMARY OF THE INVENTION

An object of the present invention is to provide a photoconductive member having electrical, optical and photoconductive characteristics which is constantly stable and all-environment type with virtually no dependence on the environments under use, which member is markedly excellent in light fatigue resistance without causing deterioration phenomenon when used repeatedly, exhibiting no or substantially no residual potential observed.

Another object of the present invention is to provide a photoconductive member having excellent electrophotographic characteristics, which is sufficiently capable of retaining charges at the time of charging treatment for formation of electrostatic images to the extent such that a conventional electrophotographic process can be very effectively applied when it is provided for use as an image forming member for electrophotography.

A further object of the present invention is to provide a photoconductive member for electrophotography capable of providing easily a high quality image which is high in density, clear in halftone and high in resolution.

Still another object of the present invention is to provide a photoconductive member having high photosensitivity, high SN ratio characteristics and good electrical contact between the laminated layers.

According to the present invention, there is provided a photoconductive member comprising a support and a light receiving layer provided on said support having photoconductivity containing silicon atoms as a matrix and at least hydrogen atoms as its constituent atoms said light receiving layer having a layer region with depth profile such that the content of hydrogen atoms contained therein is decreased in the direction of layer thickness toward both ends of said layer.

DESCRIPTION OF THE PREFERRED EMBODIMENTS

Figure 1:
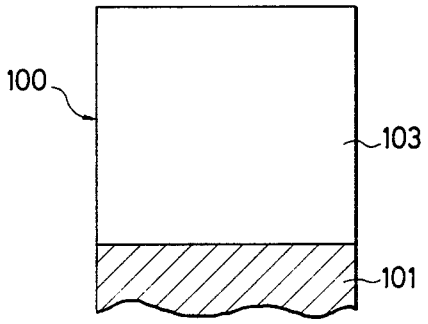
FIG. 1, FIG. 2 and FIG. 4 each shows a schematic sectional view for illustration of an embodiment constitution of the photoconductive member according to the present invention.

Referring now to the drawings, the photoconductive members according to the present invention are to be described in detail below.

FIG. 1 shows a schematic sectional view for illustration of the layer structure of a preferable embodiment of the constitution of the photoconductive member of this invention.

Figure 2:
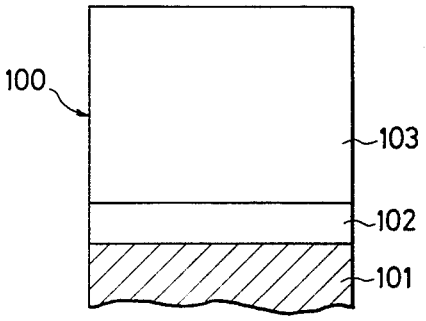
Figure 3:
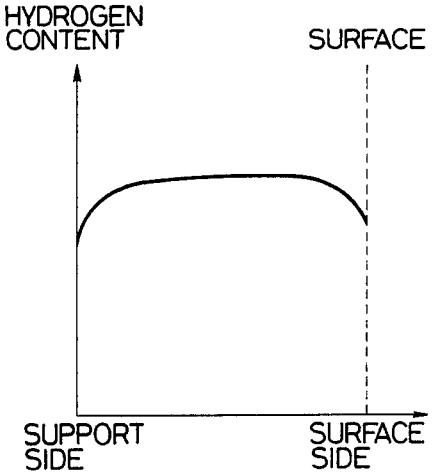
FIG. 3 is a schematic illustration of the hydrogen atom depth profile in the light receiving layer of the photoconductive member of the present invention.

The photoconductive member 100 is constituted of a light receiving layer 103 comprising a-Si(H,X) or mainly a-Si(H,X) having photoconductivity formed on a support 101 for photoconductive member as shown in FIG. 1, or on the support through an intermediary lower layer 102 as shown in FIG. 2. The hydrogen atoms contained in the light receiving layer distribute with a depth profile which is uniform in the direction parallel to the support surface, but decreased in its content toward the both ends of the light receiving layer with respect to the thickness direction of said layer, as shown in FIG. 3.

The hydrogen atoms contained in the light receiving layer 103 are required as described above to be greater in content in the inner portion thereof than those at the both ends, and the contents at the both ends may be equal to each other or different depending on the material contacted with said layer. On the other hand, the portion having the maximum hydrogen content in the inner portion of said layer may have a certain range in the thickness direction or it may also be only single spot. Further, as for depletion in hydrogen atom content toward the end portions, it may be changed either continuously or stepwise to give no essential difference, and it is a matter of suitable choice depending on the balance between the function required for the image forming member and installations for production of the photoconductive member whether what kind of depth profile should be provided.

The reason why the photoconductive member of the present invention having a light receiving layer formed so that the hydrogen content is thus decreased toward both ends thereof is extremely excellent in repeating characteristics of image and durability when used as a photosensitive member for electrophotography may be speculated to be based on the structure of the light receiving layer, which is decreased in content of hydrogen atoms liable to be splitted from silicon atoms at relatively lower temperatures in the vicinity of the surface or at the interface between said layer and the lower layer or the support most susceptible to structural changes in the light receiving layer during a preparation and application.

The content of hydrogen atoms in the light receiving layer 103 may preferably be 0.1 to 40 atomic %, more preferably 1 to 30 atomic %, at its maximum portion, namely at the center portion of said layer, while it may preferably be 0.05 to 30 atomic %, more preferably 0.3 to 20 atomic %, at the minimum portion, namely at the ends thereof. The difference between the maximum portion and the minimum portion may preferably be 0.01 to 35 atomic %, more preferably 0.1 to 25 atomic %.

As the components other than silicon atoms, hydrogen atoms and halogen atoms contained in the light receiving layer 103, there may be contained the group III atoms of the periodic table such as boron, gallium, etc., the group V atoms such as nitrogen, phosphorus, arsenic, etc. as the components for controlling the width of fobidden band or Fermi level, and further oxygen atoms, carbon atoms, germanium atoms and others, either individually or in a suitable combination thereof.

The lower layer 102 is provided for the purpose of improving adhesion between the light receiving layer and the support or controlling the capacity of impeding charges, and it can be formed as a monolayer or a multilayer of a-Si(H,X) layer or microcrystalline-Si(H,X) layer containing the group III atoms, the group V atoms, oxygen atoms, carbon atoms, germanium atoms, etc. depending on the purpose. When the lower layer 102 is constituted of an a-Si(H,X) layer, it is also desirable similarly as in the case of the above-mentioned light receiving layer that the hydrogen atom content within said lower layer should be decreased toward the layer interface between the light receiving layer and the lower layer.

Figure 4:
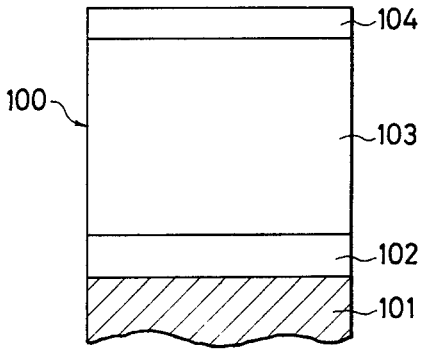

Also, as shown in FIG. 4, it is possible to provide an upper layer as the charge injection preventive layer or the protective layer on the light receiving layer 103, said upper layer comprising an amorphous silicon containing a large amount of carbon atoms, nitrogen atoms, oxygen atoms, etc. or comprising an organic substance with high resistance. In the case of this upper layer, it is also desired to be formed so that the hydrogen content within said layer may be decreased toward the interface between the light receiving layer and the upper layer, and toward the surface of the upper layer. The support to be used in the present invention may be either electroconductive or insulating. As the electroconductive material, there may be mentioned metals such as NiCr, stainless steel, Al, Cr, Mo, Au, Nb, Ta, V, Ti, Pt, Pd, etc. or alloys thereof.

As insulating supports, there may conventionally be used films or sheets of synthetic resins, including polyester, polyethylene, polycarbonate, cellulose acetate, polypropylene, polyvinyl chloride, polyvinylidene chloride, polystyrene, polyamide, etc., glasses, ceramics, papers and so on. These dielectric supports should preferably have at least one surface subjected to electroconductive treatment, and it is desirable to provide other layers on the side at which said electroconductive treatment has been applied.

For example, electroconductive treatment of a glass can be effected by providing a thin film of NiCr, Al, Cr, Mo, Au, Ir, Nb, Ta, V, Ti, Pt, $In_2O_3$, $SnO_2$, ITO ($In_2O_3+SnO_2$) and the like, thereon. Alternatively, a synthetic resin film such as polyester film can be subjected to the electroconductive treatment on its surface by vacuum vapor deposition, electron-beam deposition or sputtering of a metal such as NiCr, Al, Ag, Pb, Zn, Ni, Au, Cr, Mo, Ir, Nb, Ta, V, Ti, Pt, etc. or by laminating treatment with said metal, thereby imparting electroconductivity to the surface. The support may be shaped in any form which may be determined as desired. For example, when the photoconductive member 100 in FIG. 1 is to be used as an image forming member for electrophotography, it may desirably be formed into an endless belt or a cylinder for use in continuous high speed copying. The support may have a thickness, which is conveniently determined so that a photoconductive member as desired may be formed. When the photoconductive member is required to have a flexibility, the support is made as thin as possible, so far as the function of a support can be exhibited. However, in such a case, the thickness is preferably 10 $\mu$m or more from the points of fabrication and handling of the support as well as its mechanical strength.

In the present invention, formation of a light receiving layer constituted of a-Si(H,X) may be conducted according to the vacuum deposition method utilizing discharging phenomenon, such as glow discharge method, sputtering method or ion-plating method. For example, for formation of the light receiving layer constituted of a-Si(H,X) according to the glow discharge method, the basic procedure comprises introducing a starting gas for Si supply capable of supplying silicon atoms (Si) together with a starting gas for introduction of hydrogen atoms (H) and, if desired, halogen atoms (X) into the deposition chamber which can be internally brought to a reduced pressure, and exciting glow discharge in said deposition chamber, thereby forming a layer consisting of a-Si(H,X) on the surface of a support set at a predetermined position. Alternatively, for formation according to the sputtering method, a gas for introduction of hydrogen atoms (H) and, if desired, halogen atoms (X) may be introduced into the deposition chamber for sputtering when sputtering a target constituted of Si in an atmosphere of an inert gas such as Ar, He or a gas mixture based on these gases.

The starting gas for supplying Si to be used in the present invention may include gaseous or gasifiable hydrogenated silicons (silanes) such as $SiH_4$, $Si_2H_6$, $Si_3H_8$, $Si_4H_{10}$ and others as effective materials. In particular, $SiH_4$ and $Si_2H_6$ are preferred with respect to easy handling during layer formation and efficiency for supplying Si.

Introduction of hydrogen atoms into the light receiving layer in the present invention may be practiced by supplying gas primarily of $H_2$ or hydrogenated silicon such as $SiH_4$, $Si_2H_6$, $Si_3H_8$, $Si_4H_{10}$, etc. into a deposition chamber and exciting discharing therein.

Effective starting gases for introduction of halogen atoms to be used in the present invention may include a large number of halogen compounds, as exemplified by halogen gases, halides, interhalogen compounds, or gaseous or gasifiable halogen compounds such as silane derivatives substituted with halogens. Further, there may also be included gaseous or gasifiable silicon compounds containing halogen atoms constituted of silicon atoms and halogen atoms as constituent elements as effective ones in the present invention.

Typical examples of halogen compounds preferably used in the present invention may include halogen gases such as of fluorine, chlorine, bromine or iodine, interhalogen compounds such as BrF, ClF, $ClF_3$, $BrF_5$, $BrF_3$, $IF_3$, $IF_7$, ICl, IBr, etc.

As the silicon compounds containing halogen atoms, namely so called silane derivatives substituted with halogens, there may preferably be employed silicon halides such as $SiF_4$, $Si_2F_6$, $SiCl_4$, $SiBr_4$ and the like.

When the light receiving layer containing hydrogen atoms is to be formed according to the glow discharge method, the basic procedure compirses introducing a hydrogenated silicon gas as the starting gas for Si supply and a gas such as Ar, $H_2$, He, etc. at a predetermined mixing ratio and gas flow rates into a deposition chamber for formation of the light receiving layer and exciting glow discharging therein to result in a plasma atmosphere of these gases, whereby the light receiving layer can be formed on a desired support. For the purpose of introducing halogen atoms, a gas of a silicon compound containing halogen atoms may further be mixed at a predetermined amount with these gases for layer formation. The respective gases may be used not only as single species but as a mixture of plural species.

For formation of the light receiving layer comprising a-Si(H,X) according to the sputtering method or the ion plating method, for example, in the case of the sputtering method, a target comprising Si may be used and sputtering of this target is effected in a certain gas plasma atmosphere. Alternatively, in the case of the ion plating method, a polycrystalline silicon or monocrystalline silicon is placed as the vaporizing source in a vapor deposition boat, and the vaporizing source is vaporized by heating according to the resistance heating method or the electron beam method to be permitted to fly and pass through a certain gas plasma atmosphere.

In either of the sputtering method and the ion plating method, introduction of hydrogen atoms into the layer formed may be effected by introducing a gas of, for example $H_2$ or the aforesaid silanes, etc. into the deposition chamber and forming a plasma atmosphere of said gas.

Also, for introduction of halogen atoms, a starting gas for introduction of halogen atoms, a gas of the aforesaid halide compounds or the silicon compounds containing halogen atoms as mentioned above may be introduced into the deposition chamber and a plasma atmosphere of said gas may be formed therein. As the starting gas for introduction of halogen atoms, the halogen compounds or silicon compounds containing halogens as mentioned above can effectively be used. In addition, it is also possible to use a gaseous or gasifiable substance such as hydrogen halide, including HF, FCl, FBr, HI and the like or halo-substituted hydrogenated silicon, including $SiH_2F_2$, $SiH_2I_2$, $SiH_2Cl_2$, $SiHCl_3$, $SiH_2Br_2$, $SiHBr_3$ and the like, as an effective starting material for formation of the light receiving layer.

These halides containing hydrogen atom, which can introduce hydrogen atoms very effective for controlling electrical or photoelectric characteristics into the layer during formation of the light receiving layer simultaneously with introduction of halogen atoms, can preferably be used in the present invention as the starting material for introduction of halogen atoms.

On the other hand, in the case of, for example, the reactive sputtering method, Si target may be used and $H_2$ gas, optionally together with a gas for introduction of halogen atoms, and also inclusive of inert gases such as He or Ar introduced into the deposition chamber to form a plasma atmosphere, in which the aforesaid Si target is subjected to sputtering, whereby the light receiving layer comprising a-Si(H,X) can be formed on the substrate.

Furthermore, for the purpose of doping impurities, gases such as $B_2H_6$, etc., may be introduced therein.

For controlling the amounts of hydrogen atoms (H) and halogen atoms (X) to be added, if desired, in the light receiving layer, at least one kind of, for example, the support temperature or/and the amounts of the starting materials for incorporation of hydrogen atoms (H) or halogen atoms (X) to be introduced into the deposition device system or the discharging power may be controlled.

For providing a layer region containing additive atoms other than silicon atoms, hydrogen atoms and halogen atoms in the light receiving layer and the lower layer, the starting material for introduction of such additive atoms may be used together with the above-mentioned starting material for formation of the light receiving layer during formation of a light receiving layer according to the glow discharge method or the reactive sputtering method, while controlling the amount added into the layer formed.

When the glow discharge method is employed for formation of the layer containing additive atoms constituting the light receiving layer, the starting materials for the raw gases for formation of said layer region may be formed by adding a starting material for introduction of additive atoms to the material selected suitably from the starting materials for formation of light receiving layer as mentioned above. As such a starting material for introduction of additive atoms, it is possible to use most of gaseous or gasified gasifiable substances containing at least additive atoms as constituent atoms.

As the starting material for introduction of additive atoms to be effectively used in the present invention, there may be mentioned primarily $B_2H_6$, $GaCl_3$, $BF_3$ as the material for introduction of the group III atoms; $PH_3$, $AsH_3$, etc. as the material for introduction of the group V atoms; NO, $N_2O$, $O_2$, etc. as the material for introduction of oxygen atoms; $CH_4$, $C_2H_6$, $C_3H_8$, $C_4H_{10}$, $C_2H_4$ and the like, as the material for introduction of carbon atoms; and $NH_3$, $N_2$, etc. for introduction of nitrogen atoms.

In the present invention, as the diluting gas to be used in formation of the light receiving layer according to the glow discharge method or the sputtering method, so called rare gases, such as He, Ne, Ar, etc. may be preferably used.

Next, an example of the process for producing the photoconductive member of this invention according to the glow discharge decomposition method is to be described.

Figure 5:
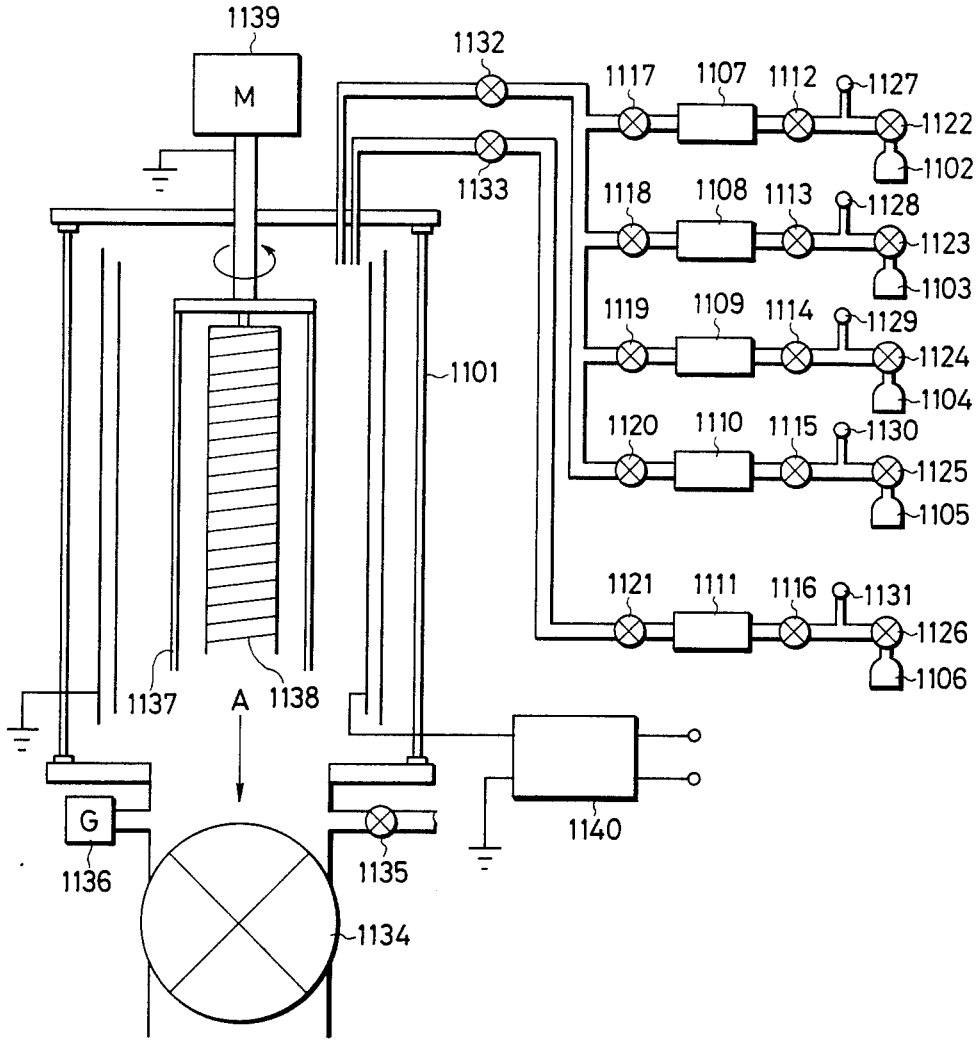
FIG. 5 is a drawing showing a device for preparation of the photoconductive member according to the glow discharge decomposition method.

FIG. 5 shows a device for producing a photoconductive member.

With reference to the drawings, in the gas bombs 1102, 1103 and 1104, there are hermetically contained starting gases for formation of the photoconductive member of the present invention. For example, 1102 is a bomb containing $SiH_4$ gas (purity: 99.99%), 1103 is a bomb containing $B_2H_6$ gas diluted with $H_2$ (purity: 99.99%, hereinafter abbreviated as "$B_2H_6/H_2$"), and 1106 is a $SiF_4$ gas bomb (purity: 99.99%). Other than these, although not shown in the drawing, it is also possible to provide additional bombs of desired gas species, if necessary.

For allowing these gases to flow into the reaction chamber 1101, on confirmation of the valves 1122–1125 of the gas bombs 1102–1105 and the leak valve 1135 to be closed, and the inflow valves 1112–1115, the outflow valves 1117–1120 and the auxiliary valves 1132 to be opened, the main valve 1134 is first opened to evacuate the reaction chamber 1101 and the $ gas pipelines. As the next step, when the reading on the vacuum gauge 1136 becomes $5\times10^{-6}$ Torr, the auxiliary valve 1132 and the outflow valves 1117–1120 are closed.

Referring now to an example of forming a photosensitive layer of the laminated layer type on the cylindrical substrate 1137, $SiH_4$ gas from the gas bomb 1102, $B_2H_6/H_2$ gas from the gas bomb 1103 and NO gas from the gas bomb 1104 are permitted to flow into the reaction chamber 1101 by controlling the pressures at the outlet pressure gauges 1127, 1128, and 1129 to 1 kg/cm$^2$, respectively, by opening the valves 1122, 1123 and 1124, opening inflow valves 1112, 1113 and 1114, and opening gradually mass-flow controllers 1107, 1108 and 1109 and the auxiliary valve 1132. The outflow valves 1117, 1118 and 1119 are controlled so that the flow rate ratio of $SiH_4$, $B_2H_6/H_2$ and NO gases may have a desired value and opening of the main valve 1134 is also controlled while watching the reading on the vacuum gauge 1136 so that the pressure in the reaction chamber may reach a desired value. And, after confirming that the temperature of the substrate cylinder 1137 is set at 50°–400° C. by the heater 1138, the power source 1140 is set at a desired power to excite glow discharge in the reaction chamber 1101.

At the same time, the discharging power, the substrate temperature or others are controlled so that the hydrogen content profile previously designed may be obtained, and the valves 1118, and 1119 are operated in the sense to obtain the desirable plasma condition changed correspondingly, thus forming a lower layer while changing adequately the flow rate of the added gases.

As the next step, formation of the light receiving layer, and sometimes further formation of the upper layer thereon are conducted. The hydrogen atom content can be controlled similarly as in formation of the above-described lower layer, and the necessary valves and control portions are operated simultaneously with control of the discharging power and the substrate temperature if desired.

The outflow valves other than those for the gases necessary for formation of respective layers are, of course, all closed, and for avoiding remaining of gases used in the preceding layer in the reaction chamber 1101 and in the pipelines from the inflow valves 1117 to 1120 to the reaction chamber 1101, the operation to close and outflow valves 1117 to 1120, with opening of the auxiliary valve 1132 and full opening of the main valve 1132, thereby evacuating once the system to high vacuum, may be conducted if desired.

During the layer formation, the substrate cylinder 1137 may be rotated at a constant speed by means of the motor 1139 in order to make layer formation uniform.

The photoconductive member of the present invention designed to have layer constitution as described above can overcome all of the problems as mentioned above and exhibit very excellent electrical, optical, and photoconductive characteristics and good environmental characteristics in use.

In particular, when it is applied as an image forming member for electrophotography, it is excellent in charge holding ability without any influence of residual potential on image formation at all, being stable in its electrical properties with high sensitivity and having high SN ratio as well as excellent light fatigue resistance and repeated usage characteristics, whereby it is possible to obtain stably and repeatedly visible images of high quality with high concentration, clear halftone and high resolution.

The present invention is illustrated by way of the examples.

EXAMPLE 1

Figure 6:
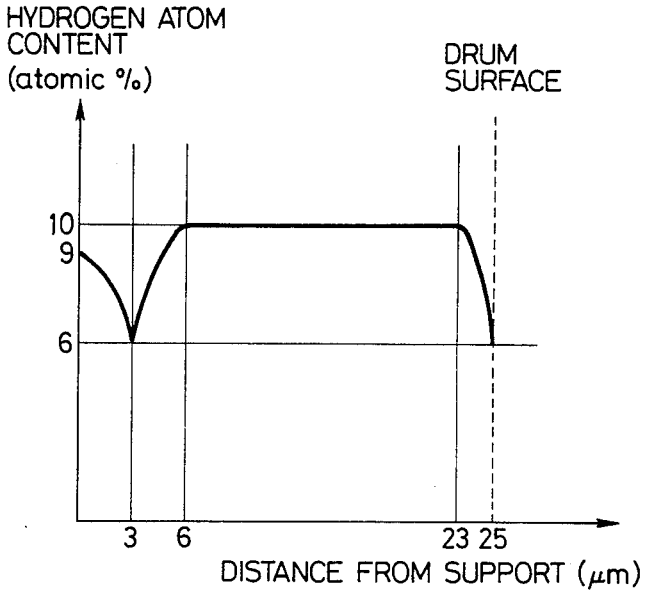
FIGS. 6 through 10 are charts showing the analytical results of the hydrogen atom depth profile in the photoconductive member according to Examples of the present invention.

By means of the device for preparation of photoconductive member as shown in FIG. 5, a lower layer and a light receiving layer were formed successively on an aluminum by the glow discharge method above mentioned. The preparation conditions for respective layers are shown in Table 1. The photosensitive member obtained was cut from a part of the drum, and quantitative determination of the hydrogen content in the direction of layer thickness was practiced by use of a secondary ion mass analyzer to obtain the result of the depth profile as shown in FIG. 6. Also, the residual part of the photosensitive drum was set in an electrophotographic device for image evaluation. Image evaluation was performed by practicing image formation in total number to 200,000 sheets under normal environment, and every sample per 10,000 sheets was evaluated for its superiority or inferiority in terms of density, resolution, gradation reproducibility, image defect, etc. As the result, each sample was confirmed to have an image of extremely high quality.

Next, this photosensitive drum was heated in an electric furnace at 300° C. for 2 hours, and after cooling, reset in the electrophotographic device for practicing image formation again. As the result, no change was observed at all. Further, this photosensitive drum was subsequently placed in an exposure test box wherein halogen lamps are set on the wall surface and uniform light irradiation can be performed on a photosensitive drum, and light irradiation corresponding to 200 $mW/cm^2$ was effected continuously for 24 hours. After cooling, image formation was conducted again, but also in this case no change was observed at all.

From the experiments as described above, this photosensitive was confirmed to have durability under by far severer conditions than practical use environments. Thus, it was experimentally proved that improvement without concomitant side effect could be obtained by coping with the behavior of hydrogen atoms within the light receiving layer relatively sensitive to the external environment, especially by reducing its content at the layer interface where its variation is liable to appear.

EXAMPLE 2

Figure 7:
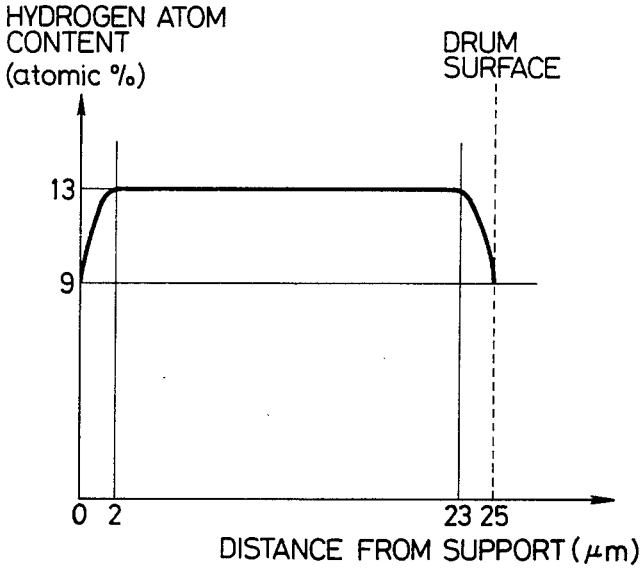

A photosensitive drum was prepared according to the same procedure as in Example 1 except that the light receiving layer was provided directly on an aluminum cylinder. The details about the preparation conditions are shown in Table 1. For this photosensitive drum, entirely the same analysis of hydrogen atom content, image evaluation and durability test were practiced. As the result, the depth profile of hydrogen atom as shown in FIG. 7 was obtained, and the results of image evaluation and durability test were also as good as in Example 1.

EXAMPLES 3–5

Figure 8:
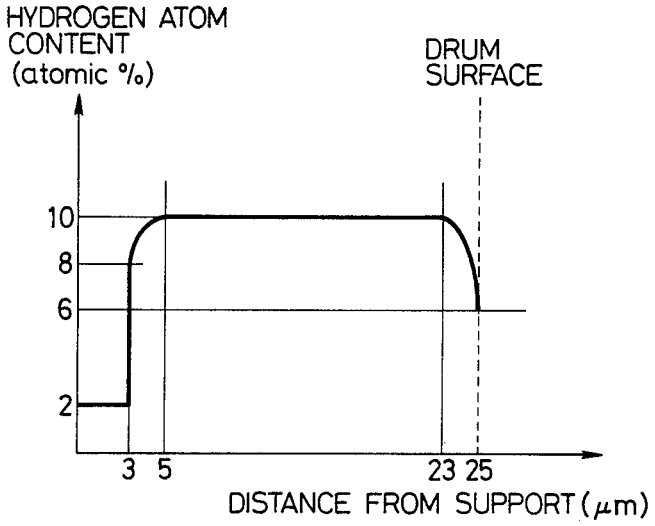
Figure 9:
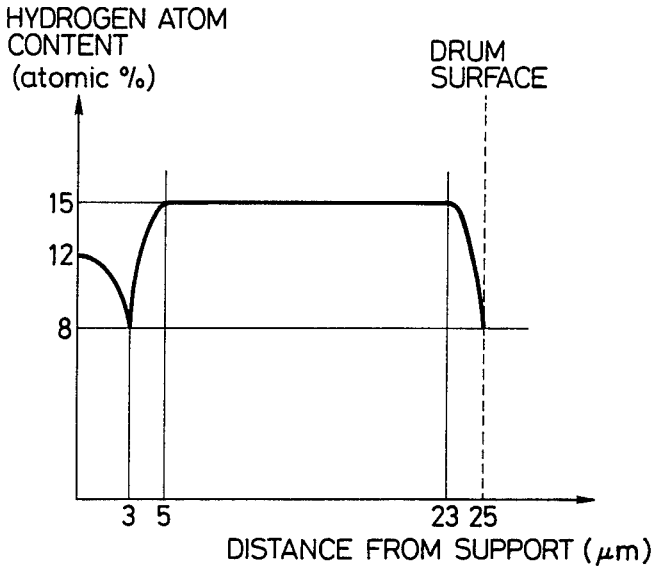
Figure 10:
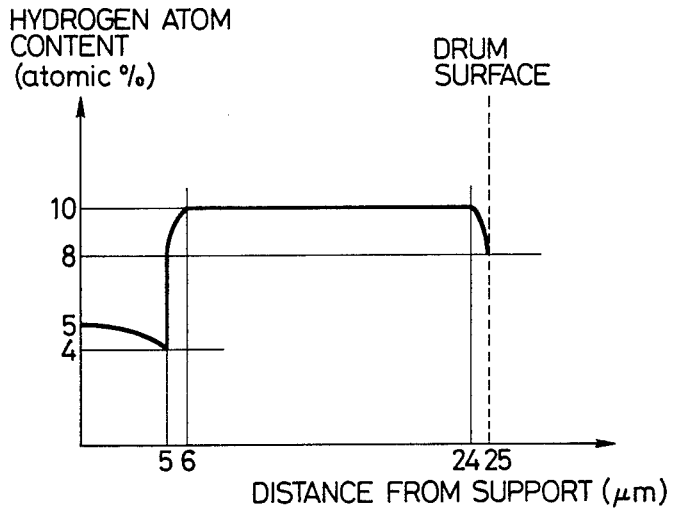

Photosensitive drums were prepared by repeating the procedure of Example 1 except for changing the depth profiles of hydrogen atom as shown in FIGS. 8 to 10, and evaluated similarly. As the result, in each case, it was found that the same high quality of image as in Example 1 could be maintained.

EXAMPLES 6–10

Figure 11:
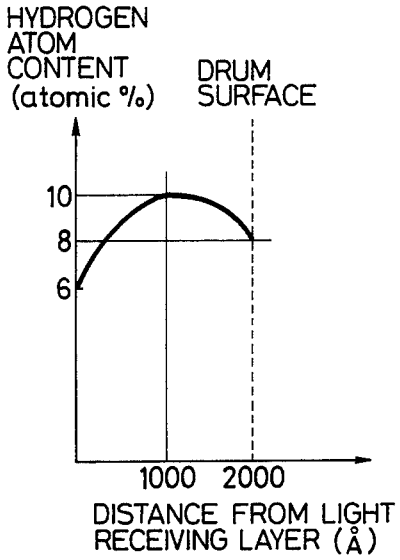
FIG. 11 is a chart showing the analytical result of the hydrogen atom depth profile in the surface layer of the photoconductive member according to an Example of the present invention.

On the respective deposited films according to the same processes as in Examples 1 to 5, upper layers were laminated under the preparation conditions as shown in Table 1 continuously while holding the vacuum. The analytical result of the depth profile of hydrogen atoms in the upper layers obtained is shown in FIG. 11. As the result of image evaluation conducted similarly as in Example 1, it was found that the level of high quality could be maintained without affecting any bad influence on image quality at all.

Comparative example 1

Figure 12:
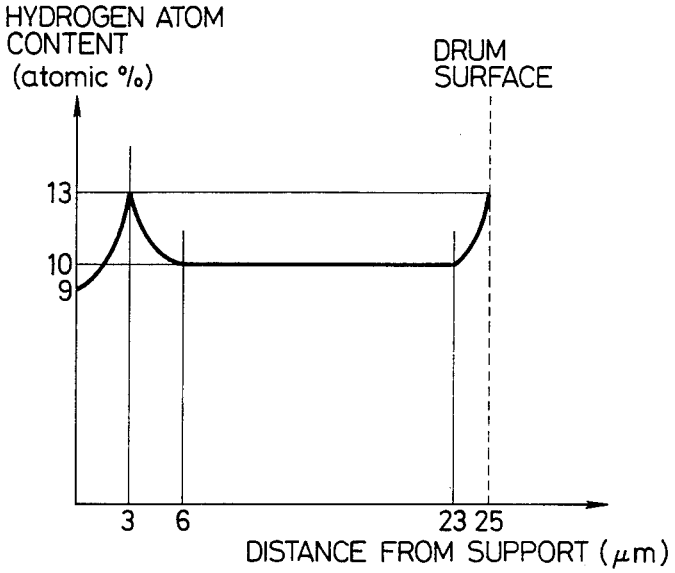
FIG. 12 is a chart showing the analytical result of the hydrogen atom depth profile in the photoconductive member according to a Comparative Example.

A photosensitive drum was prepared according to the same procedure as in Example 1 except that the mode of the depth profile of hydrogen atoms was changed as shown in FIG. 12 so that hydrogen atoms were increased at the interface portion of the light receiving layer. When evaluation was conducted for this photosensitive drum similarly to in Example 1, the results with respect to the desired image and the image relative to the environmental change in a copying device were both substantially comparable to those as in Example 1. However, in each of high temperature annealing and light irradiation, potential reduction and increased image defect were observed, thus giving the result to provide a material with uncertainly in durability in practical mounting number of sheets on the order of 1,000,000.

Figure 13:
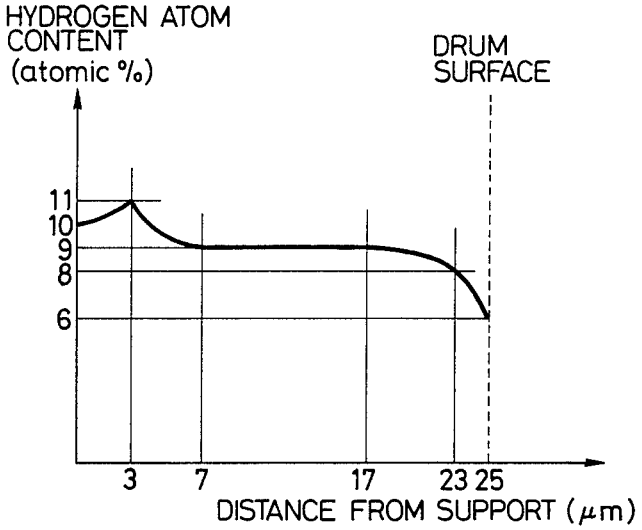
FIG. 13 is a chart showing the result of the retest conducted for the same sample after completion of all of the tests.

After completion of all the tests for this photosensitive drum, analysis of hydrogen atom content was carried out again to obtain the result as shown in FIG. 13, wherein the changes can be seen to prove the fact that the above deterioration is related to escape or diffusion of hydrogen atoms.

TABLE 1

| | Example No. | | | |
|---|---|---|---|---|
| | 1 | | 2 | 6-10 |
| Layer | Lower layer | Light receiving layer | Light receiving layer | Upper layer |
| Gases employed and their flow rates (SCCM) | $SiH_4$:150<br>$H_2$:600<br>$B_2H_6$:0.45<br>NO:5.1 | $SiH_4$:300<br>$H_2$:1200 | $SiH_4$:300<br>$B_2H_6$:0.03<br>NO:10.2 | $SiH_4$:20<br>$CH_4$:600 |
| Discharging power (W/cm) | 0.1 → 0.03 | 0.02 → 0.1 → 0.02 | 0.01 → 0.15 → 0.01 | 0.03 → 0.15 → 0.05 |
| Layer forming speed (Å/sec) | 12 → 4 | 4 → 15 → 4 | 3 → 18 → 3 | 1 → 3 → 1.2 |
| Layer thickness | 3 μm | 22 μm | 25 μm | 2000Å |
| Pressure during reaction (Torr) | 0.8 → 0.78 | 1.14 → 1.2 → 1.14 | 0.29 → 0.32 → 0.29 | 0.4 |
| Cylinder temperature (°C.) | 250 | 250 | 250 | 250 |
| Discharging frequency (MHz) | 13.56 | 13.56 | 13.56 | 13.56 |

What is claimed is:

1. A photoconductive member comprising a support and a light receiving layer provided on said support, having photoconductivity and containing an amorphorous material comprising silicon atoms as a matrix and at least hydrogen atoms as constituent atoms in said light receiving layer having a layer region with depth profile such that the content of hydrogen atoms contained therein is decreased in the direction of layer thickness toward both ends of said layer.

2. A photoconductive member according to claim 1, wherein the contents of hydrogen atoms in the light receiving layer are equal at the both ends.

3. A photoconductive member according to claim 1, wherein the contents of hydrogen atoms in the light receiving layer are different at the both ends.

4. A photoconductive member according to claim 1, wherein the depth profile of hydrogen atoms in the light receiving layer has a maximum valve for hydrogen content.

5. A photoconductive member according to claim 4, wherein the portion of the maximum value has a range.

6. A photoconductive member according to claim 1, wherein the depth profile of hydrogen atoms is reduced toward the both end portions with continuous changes.

7. A photoconductive member according to claim 1, wherein the depth profile of hydrogen atoms is reduced toward the both end portions with stepwise changes.

8. A photoconductive member according to claim 1, wherein the depth profile of hydrogen atoms is reduced toward the both end portions with continuous changes in one direction and stepwise changes in the other direction.

9. A photoconductive member according to claim 1, wherein the content of hydrogen atoms in the light receiving layer is within the range from 0.1 to 40 atomic % at the maximum portion.

10. A photoconductive member according to claim 1, wherein the content of hydrogen atoms in the light receiving layer is within the range from 0.05 to 30 atomic % at the minimum portion.

11. A photoconductive member according to claim 1, wherein the difference in hydrogen content in the light receiving layer between the maximum portion and the minimum portion is within the range from 0.01 to 35 atomic %.

12. A photoconductive member according to claim 1, wherein the content of hydrogen atoms in the light receiving layer is 0.1 to 40 atomic % at the maximum portion and 0.05 to 30 atomic % at the minimum portion, and the difference in hydrogen atom content between the maximum and minimum portions is 0.01 to 35 atomic %.

13. A photoconductive member according to claim 1, wherein halogen atoms are contained in the light receiving layer.

14. A photoconductive member according to claim 1, wherein the group III atoms of the periodic table are contained in the light receiving layer.

15. A photoconductive member according to claim 1, wherein the group V atoms of the periodic table are contained in the light receiving layer.

16. A photoconductive member according to claim 1, wherein both of halogen atoms and the group III atoms of the periodic table are contained in the light receiving layer.

17. A photoconductive member according to claim 1, wherein both of halogen atoms and the group V atoms of the periodic table are contained in the light receiving layer.

18. A photoconductive member according to claim 1, wherein there is provided between the support and the light receiving layer a lower layer comprising an amorphous material or a microcrystalline material containing silicon atoms as a matrix and at least one of hydrogen atoms and halogen atoms as a constituent atom.

19. A photoconductive member according to claim 18, wherein the lower layer contains at least one of oxygen atoms, carbon atoms and germanium atoms.

20. A photoconductive member according to claim 18, wherein the group III atoms of the periodic table are contained in the lower layer.

21. A photoconductive member according to claim 18, wherein the group V atoms of the periodic table are contained in the lower later.

22. A photoconductive member according to claim 19, wherein both of the group III atoms and the group V atoms of the periodic table are contained in the light receiving layer.

23. A photoconductive member according to claim 1, wherein there is provided on the light receiving layer an upper layer containing silicon atoms as a matrix and at least one of carbon atoms, nitrogen atoms and oxygen atoms as a constituent atom.

24. A photoconductive member according to claim 1, wherein there is provided on the light receiving layer an upper layer comprising a silicon atom as a matrix and a high resistance organic substance as a constituent.

25. A photoconductive member according to claim 1, wherein there is provided on the light receiving layer an upper layer containing an organic material of high electric resistance.

26. A photoconductive member according to claim 18, wherein there is provided on the light receiving layer an upper layer containing silicon atoms as a matrix and at least one of carbon atoms, nitrogen atoms and oxygen atoms.

27. A photoconductive member according to claim 18, wherein there is provided on the light receiving layer an upper layer containing an organic material of high electric resistance.

28. A photoconductive member according to claim 19, wherein the lower layer further contains atoms either of the group III or the group V of the periodic table.

* * * * *

UNITED STATES PATENT AND TRADEMARK OFFICE

CERTIFICATE OF CORRECTION

PATENT NO. : 4,555,465

DATED : November 26, 1985

INVENTOR(S) : Ogawa, et al.

It is certified that error appears in the above-identified patent and that said Letters Patent is hereby corrected as shown below:

Column 1, line 24, "In particulary" should be --In particular--.
Column 6, line 28, "exciting discharing" should be --exciting discharge--.
Column 6, line 51, "compirses" should be --comprises--.
Column 8, line 46, "the $ gas" should be --the gas--.
Column 9, line 6, "1118, and" should be --1118 and--.
Column 9, line 25, "close and" should be --close the--.
Column 9, line 27, "valve 1132" should be --valve 1134--.
Column 9, line 55, "aluminum by" should be --aluminum drum by--.
Column 10, line 16-17, "this photosensitive was" should be --this photosensitive drum was--.
Column 11, line 5, "uncertainly" should be --uncertainty--.
Column 11, line 52, "maximun valve" should be --maximum value--.
Column 13, line 3, "lower later" should be --lower layer--.

Signed and Sealed this

Second Day of December, 1986

*Attest:*

DONALD J. QUIGG

*Attesting Officer*

*Commissioner of Patents and Trademarks*